US010151560B2

(12) United States Patent
Sparling

(10) Patent No.: US 10,151,560 B2
(45) Date of Patent: Dec. 11, 2018

(54) APPARATUS FOR LAUNCHING INCENDIARY SPHERES

(71) Applicant: Frederick Sparling, Fredericton (CA)

(72) Inventor: Frederick Sparling, Fredericton (CA)

( * ) Notice: Subject to any disclaimer, the term of this patent is extended or adjusted under 35 U.S.C. 154(b) by 0 days.

(21) Appl. No.: 15/265,220

(22) Filed: Sep. 14, 2016

(65) Prior Publication Data

US 2017/0003102 A1 Jan. 5, 2017

Related U.S. Application Data

(63) Continuation-in-part of application No. 14/622,552, filed on Feb. 13, 2015, now abandoned.

(51) Int. Cl.
*F42B 12/44* (2006.01)
*F41F 7/00* (2006.01)
*A62C 3/02* (2006.01)

(52) U.S. Cl.
CPC ..... *F41F 7/00* (2013.01); *A62C 3/025* (2013.01); *A62C 3/0285* (2013.01); *F42B 12/44* (2013.01)

(58) Field of Classification Search
CPC ..... F42B 12/44; F41F 7/00; A62C 3/0285; A62C 3/025; A62C 3/08; A63B 69/406
USPC ..... 89/1.51; 102/364, 336; 124/71, 78, 66
See application file for complete search history.

(56) References Cited

U.S. PATENT DOCUMENTS 2,278,949 A * 4/1942 Sabini ..... G08B 15/02 109/20
2,379,784 A * 7/1945 Brand ..... F41A 9/30 102/274
3,785,358 A * 1/1974 D'Angelo ..... A63B 69/406 124/34
5,816,232 A * 10/1998 Bell ..... F41B 11/53 124/48
6,877,433 B1 4/2005 Stevenson
7,275,529 B2 * 10/2007 Boys ..... F41B 7/00 124/66
7,451,679 B2 11/2008 Stevenson et al.
8,316,750 B2 11/2012 Toeckes et al.
8,434,397 B1 * 5/2013 Deckard ..... B64D 7/06 89/37.13
8,601,929 B2 12/2013 Stevenson
8,776,693 B2 7/2014 Toeckes et al.
2003/0006319 A1 * 1/2003 Silverstein ..... A62C 3/025 239/672

(Continued)

FOREIGN PATENT DOCUMENTS

CA 2761242 6/2013

*Primary Examiner* — Michael D David
(74) *Attorney, Agent, or Firm* — Harding, Earley, Follmer & Frailey, PC; Frank J. Bonini, Jr.; John F. A. Earley, III

(57) ABSTRACT

An apparatus for launching incendiary spheres for prescribed burning is provided. This apparatus receives 'charged', or injected, spherical incendiaries, then launches them in a controlled direction at a controlled distance. The charged incendiaries are first emitted from a conventional Plastic Sphere Dispenser (PSD) into the intake of the apparatus whereupon they are moved along a lower pathway by a delivering wheel to a launching point relative to a spinning wheel or a plurality of spinning wheels. These spinning wheels convey velocity to each incendiary sphere, which is thereby launched in a trajectory that is determined by the azimuth of orientation, and the rotational velocity, of the spinning wheels.

16 Claims, 17 Drawing Sheets

Ball Thrower Final Assembly
(below)

(56) References Cited

U.S. PATENT DOCUMENTS

| | | | | |
|---|---|---|---|---|
| 2004/0074487 | A1* | 4/2004 | Christopher | F41B 11/57 124/56 |
| 2006/0027380 | A1* | 2/2006 | Stevenson | A62C 3/0285 169/45 |
| 2006/0169263 | A1 | 8/2006 | Boys | |
| 2010/0101401 | A1* | 4/2010 | Toeckes | A62C 3/08 89/1.51 |
| 2010/0282230 | A1* | 11/2010 | Toeckes | A62C 3/025 124/71 |
| 2013/0061738 | A1* | 3/2013 | Stevenson | F41B 4/00 89/1.51 |
| 2014/0283672 | A1* | 9/2014 | Sparling | B64D 1/06 89/1.51 |
| 2016/0265890 | A1* | 9/2016 | Sparling | F41F 7/00 |

* cited by examiner

Main Base Plate Assembly

Spinner Base Plate

Feeder Tube Assembly

Feeder Tube Assembly

Delivering Wheel Assembly

Delivering Wheel Assembly

Feeder Assembly

Feeder Assembly

Feeder Head Assembly
(above)

Feeder Head Assembly
(front)

Feeder Head Assembly
(behind)

Rotating-Top Assembly
(above)

Rotating-Top Assembly
(below)

Rotation Assembly

Ball Thrower Final Assembly
(below)

Ball Thrower Final Assembly
(above)

APPARATUS FOR LAUNCHING INCENDIARY SPHERES

CROSS-REFERENCE TO RELATED APPLICATIONS

This application claims the benefit under 35 U.S.C. § 120 as a continuation-in-part of U.S. patent application Ser. No. 14/622,552, filed on Feb. 13, 2015, the complete contents of which are herein incorporated by reference.

BACKGROUND OF THE INVENTION

1. Field of the Invention

This invention relates to intentional burning, often called 'prescribed burning' for wild-land and wildlife management purposes, and in particular to an apparatus for launching incendiary spheres for the purpose of conducting such prescribed burning.

2. Brief Description of the Related Art

Prescribed burning is a common activity that is well recognized to produce many wild-land, environmental, agricultural and wildlife benefits. A variety of methods and devices are employed to do this. One main methodology uses flammable liquid or, flammable sludge, which is ignited as it exits the ignition device. Examples of such devices range from hand held 'drip torches' to helicopter slung 'heli-torches', or to vehicle-mounted or vehicle-towed devices, often called 'terra-torches', which eject ignited fuel under pressure much as does a military-type flamethrower. All flammable liquid methods carry with them certain disadvantages. The first such disadvantage is the obvious potential danger to the personnel who operate these devices. Such danger may arise for instance as an unintended consequence of misdirected flame, or possibly by explosion. Secondly, although such devices are effective for starting fires, they tend to consume a large quantity of fuel relative to both the number of fires they start, and to the total area they burn; consequently there exists an ongoing need to re-fuel these devices, which includes the storage, transportation, and often mixing of fuel, which imposes a significant operational challenge in the field. This re-fueling requirement also adds environmental risk and significant expense. Thirdly, there exist several physical limitations regarding the design, construction, and operation of any mechanical device which processes and ignites flammable liquids. Such limitations can be related for instance to the need to avoid fuel or flame leakage, or to mitigate the consequences if such leakage occurs, or to other design restrictions due to the potentially detrimental effect of burning fuel upon the mechanical or electrical components of the device. These are some of the reasons why it is desirable to design and employ an ignition apparatus which processes neither flammable liquid, nor flame itself.

One existing method of igniting prescribed burns which avoids the need to emit ignited liquids is that commonly referred to as 'delayed ignition'. The most common method of delayed ignition is a machine that processes plastic incendiary spheres. Such a machine is known as a "plastic sphere dispenser" (PSD). Each plastic sphere is partly filled with an incendiary such as potassium permanganate, and, as the sphere is processed within the machine it is injected with a reactant such as ethylene glycol. As a result, after a delay of about 20-40 seconds, the now-mixed chemicals react with one another to create flame, which then causes the plastic sphere to burn. This burning sphere becomes the source of ignition for whatever ground material is intended to be burnt. The main advantage of delayed ignition is the delay itself. This is what allows for a method, or device, that does not have to process actual flame with all of the difficulties associated with doing so, but rather it processes what can be referred to as a 'pre-flame' incendiary sphere. This 'delayed ignition' technique is the method referenced in the present invention.

It is often desirable to conduct prescribed burning from the air. This is especially true if the terrain is difficult or impossible to traverse by ground, or if the area to be burnt is very large, in which case the time required to do so by traditional ground based methods may exceed the time window within which optimal burning conditions (wind speed and direction, temperature, relative humidity, etc.) can be expected to persist. When prescribed burning is conducted from the air, this is usually done by helicopter. This can be done by 'Heli-torch' as previously mentioned, or, it can be done by installing a PSD within the cabin of the helicopter. A PSD is capable of producing 'charged', or injected spheres, which are dropped by gravity from the aircraft to the ground. There are presently several PSD machines on the market, to site the four known such devices by their marketing name, they are: the 'Mark III', the 'Red Dragon™' (US 2010101401 A1), the Mark V' and the 'Spitfire'™ (CA 2,761,242/U.S. patent application Ser. No. 14/061,511, now U.S. Pat. No. 9,199,735 B2). There exist other devices which dispense delayed-ignition capsules such as the Raindance R2 (U.S. Pat. No. 7,451,679 B2) but these are not relevant to this general discussion because they do not dispense incendiaries that are sphere shaped.

All of the above PSD machines however are restricted by their design in that, by themselves, they can only practically be used by helicopter. Were it attempted to deploy one by ground vehicle the consequence would be of very little practical benefit. This is because the PSD machine, by itself, is not capable of launching the charged incendiary for a distance; it can only drop it straight down by gravity. This is perfectly acceptable and practical of course when using the PSD by helicopter because it is merely a matter of maneuvering the helicopter directly over the area that is desired to be burned, but the same machine, if deployed by ground vehicle, would only drop the incendiary right on the trail that the vehicle is travelling on. In nearly every case it is not the trail itself that is desired to be burned but the area beside the trail; this desired adjacent area could be anywhere from a few feet away to a hundred feet or more from the trail. This therefore explains the rationale for the present invention; namely: to provide an apparatus which will receive a charged incendiary from a PSD machine and then launch it for a distance, thus allowing a helicopter-deployed PSD machine to also be used by ground vehicle. Given the fact that an incendiary, once charged is about to burst in flame in about 25 seconds time, and another one is normally coming right behind it, the launcher must operate quickly and it must operate jam free. It must also be capable of reliably processing incendiaries no matter what rate (expressed in balls per minute or "BPM") they are received by it. In the preferred embodiment for instance the present invention is capable of launching incendiaries at any rate between 1 and 200 BPM, which of course is a very widely varied BPM range, a greater range than any existing PSD machine is capable of producing.

As will be seen, the present invention launches the incendiary by means of contact with a spinning wheel, or wheels. The applicant recognizes a large number of devices exist which launch a sphere, or ball by means of contact with a spinning wheel or wheels, however, the applicant is not aware of such devices being used to launch an incendiary sphere. The majority of the known ball launchers relate to some sporting activity that employs, as of course many do, some type of ball. For the most part, these sport ball throwers launch balls for the purpose of practice or training. It seems that for every sport that uses a ball there is a mechanical machine that can be used to launch that ball in series for practice or training purposes. This is certainly true for tennis, baseball, softball, basketball and football (often called 'soccer' in North America). Tennis is particularly well represented in the category of ball throwing machines that employ spinning wheels to launch the balls: the Lobster Company produces several models including ELITE series and GRAND series; there is also the Silent Partner Company which produces the LITE, the SPORT, and the STAR, and there are several other companies which produce similar products. Spinning wheel machines are also used with baseballs, softballs, basketballs and soccer balls. In the case of baseballs and softballs it is also known to employ only a single wheel in combination with a 'kick plate' which biases the ball against the spinning wheel, as opposed to the much more common two-wheel configuration used in the vast majority of sport ball throwers.

Therefore, while it is recognized that there are a great variety and quantity of machines, especially sport ball throwers in existence which do employ a spinning wheel or wheels to convey velocity to a sphere, no existing spinning-wheel machine of any description launches charged incendiary spheres, and this is despite the fact that delayed-ignition incendiary spheres have been in use for prescribed burning for about 25-30 years now. Also, it must be emphasized that the technical performance requirements for an incendiary sphere launcher in comparison to a sport ball thrower are of an altogether more exacting, critical and challenging nature. No tennis expert needs to be trained to handle three balls per second, and no sport ball will burst on fire if it jams or backlogs inside the throwing machine. The unique mechanisms which the present invention employs in order to ensure the required speed, precision and reliability of sphere handling are the inclusion of a 'delivering wheel' which operates in combination with a spring-loaded 'lower rail' and tapered-tip 'side walls'. These features are more fully described in the paragraphs that follow.

The above discussion addresses machines that launch spheres, excluding incendiary spheres, by means of contact with spinning wheels, but this is not to say that there exists no machines that launch charged incendiaries. A series of delayed-ignition devices are produced by Field Support Services of Atlanta, Ga. The PyroShot™ (U.S. Pat. No. 7,275,529) is a spring loaded 'hand launcher for ground ignition' which indicates, of course, that it is intended for use by personnel while walking on foot. The same company has also produced an HS model which includes a CO2 tank for the purpose of propelling the charged sphere for a longer distance. Further, the same company, in partnership with another company has recently introduced its Green Dragon™ product (U.S. Pat. No. 8,316,750/CA 2,703,398). The Green Dragon also employs pressurized CO2 to launch each sphere over a long distance, and this is normally mounted on a truck or a UTV type vehicle as opposed to being used by a person on foot. All three products (hereafter referred to as PyroShot) are intended exclusively for use by ground, as opposed to aerial, deployment, and all three are used independently of a PSD. To be clear on this last point it should be explained that the term PSD (meaning: Plastic Sphere Dispenser) has become commonly used to describe those four previously mentioned machines that drop incendiary spheres from a helicopter. Strictly speaking PyroShot could just as rightly be referred to as a PSD, because it does in fact dispense-plastic-spheres; the PyroShot includes all the mechanisms necessary to inject the incendiary sphere with reactant before it launches it. Thus, a main differentiation between PyroShot and the present invention is that PyroShot is a stand-alone gun, or system, which maneuvers, injects and then launches incendiary spheres, while the present invention is an apparatus that is exclusively used only to receive charged incendiaries from an existing PSD machine and then launch them. Most significantly, in consideration of the main job that the present invention is designed to do, namely the launching of incendiary spheres, there are no obvious similarities between PyroShot and the present invention in the manner in which they accomplish that task. PyroShot employs either a spring release, or, gas pressure for motive power to launch the incendiary sphere, whereby the present invention employs spinning wheels to do so.

The applicant is aware of no other relevant art in addition to that as described above.

SUMMARY OF THE INVENTION

The general objective of the present invention is to provide an apparatus for launching incendiary spheres in a manner whereby both the azimuth and the distance the spheres are launched are controllable (hereafter, the overall apparatus that performs these functions is referred to as "Ball-Thrower"). The Ball Thrower receives 'charged', or injected, spherical plastic incendiaries, then throws, or 'launches' them for a distance. These charged incendiaries are first emitted from a conventional PSD machine into the Ball-Thrower's intake (7) whereupon they roll down along the pathway of a lower rail. Above this lower rail is mounted a delivering wheel which is rotating at a constant RPM. The distance between the delivering wheel and the lower rail is less than the circumference of the incendiary sphere. This too-tight fit is accommodated because the rail is mounted on a single axis and is upwardly spring mounted, meaning that when the incendiary becomes pinched between the delivering wheel and the rail, the rail moves downward and allows the incendiary to pass, and as it does so of course, there is a spring force exerted by the wheel upon the incendiary sphere. This force is what allows the wheel to maintain a purchase upon the sphere while moving it. The incendiary is thus moved by the delivering wheel along the curved pathway prescribed by the upper surface of the lower rail until the incendiary is delivered precisely to the launching point. In order for the sphere to gain access to the concave grooves of the spinning wheels it is important that the lower rail pathway, at its terminus (its last inch or so) is parallel to the fixed elevation orientation of the spinning wheels. Delivery precision is further ensured because, in addition to the vertical control just described, horizontal control is maintained by sidewalls that prevent the sphere from moving horizontally from its desired centerline. The terminating tips of both sidewalls, which are tapered and sculpted to fit as closely as possible to the grooves of the spinning wheels, thus will control the spheres horizontal position all the way to 'hand off', at which point the incendiary is already contained by the outer lips of the groove of the spinning wheel. The launching point is that point where the concave grooves of the spinning wheels grab, or embrace, the spherical circumference, of the incendiary sphere. Once a sphere is positioned to the launching point the spinning wheels then convey velocity to the incendiary, which is then thrown in a trajectory that is determined by the azimuth of orientation, and the rotational velocity of the spinning wheels. Although the plane of orientation of the spinning wheels is fixed at a constant angle about the horizontal axis, considering the vertical axis, the entire Rotating Top Assembly (14) is capable of approximately 180 degrees or more of azimuth rotation. Therefore, the direction that the incendiary is launched is controlled by means of rotating the upper portion of the apparatus, while the distance the incendiary travels is controlled by adjusting the RPM of the spinning wheels. It is to be understood that, in the preferred embodiment described herein, although we use the example of two spinning wheels, this desired launching effect could be accomplished by a variety of possible spinning wheel configurations; for instance this could be accomplished by a single spinning wheel biased to a kick plate, or by contact with three or even more spinning wheels. In terms of ensuring that the Ball-Thrower functions with adequate speed (measured in BPM, or balls-per-minute), and, with maximum reliability, the most critical elements of the design are those involved in the job of delivering the incendiary spheres quickly and exactly to the launching point of the spinning wheels. As stated, these critical elements include the delivering wheel (38), lower rail (28) and sidewalls (25*a*) and (25*b*).

Motor (40) drives the delivering wheel. In this preferred embodiment, the motor (40) is rotated at about 150 RPM. Since, from the point of first contact with the incendiary until that incendiary is delivered to the launching point, there occurs a total of only about 90 degrees of rotation of the delivering wheel, at this RPM the total time to deliver the incendiary is about 0.1 seconds (one tenth of a second). At that quick delivery rate there will never be two incendiaries beneath the delivering wheel at the same time, which would otherwise be problematic. The fastest conventional PSD machine operates at a maximum speed of about 180 balls-per-minute which equates to one incendiary each 0.33 seconds. This means that this apparatus will perform over three times faster than is necessary to avoid feeding problems including ball jams; it therefore operates, not at its very limits, but with a certain 'reserve' capacity, which is reassuring given its task.

The central structural component of the overall Ball-Thrower (57) is Main Base Plate Assembly (8). On its upper surface, main base plate (1) includes the necessary features for mounting a PSD machine. The Main Base Plate Assembly also includes an intake tube (7) through which incendiaries enter, and it includes mounting arms to attach the Feeder-Head Assembly (13). The thrower-head is a separate piece that mounts to this main base plate assembly, and which includes all of the various mechanisms involved in the actual task of launching the incendiary.

The central structural component of the Feeder-Head Assembly is the Spinner Base Plate (9). This plate mounts all of the main elements of the Feeder-Head Assembly which include Feeder Tube Assembly (10), Delivering Wheel Assembly (11) which when combined, are referred to as the Feeder Assembly (12). Also attached to the Spinner Base Plate are motors (44*a*) and (44*b*). Attached to the drive shafts of those motors are spinner wheels (58*a*) and (58*b*). Base Plate Assembly (8) and Feeder-Head Assembly (13) which are connected together to form Rotating-Top Assembly (14). The Rotating-Top Assembly includes all the mechanisms necessary to mount a PSD machine, to receive charged incendiary spheres from that PSD machine, and to launch those incendiary spheres. Although, as will be seen in the information that follows, the embodiment described herein includes means to rotate the Rotating-Top Assembly in a desired direction, or azimuth, and further includes an example of means to mount, or attach, that rotatable assembly to a vehicle, it is understood that this assembly could be rotated, if so desired, by any of a number of possible means, and it could also be mounted by any of a number of possible means. The term "Ball-Thrower" therefore as used generally in this document, while it does refer to a complete and functioning machine, should be understood to refer to a Rotating-Top Assembly as described herein which is then rotated, or mounted, by any means, of which is provided one example or embodiment for doing so.

Secured between main base plate (1) and stationary base (16) is Rotation Assembly (15). This Rotation Assembly consists of the rotating hub, motor (46), motor mount, gears and gear mounts that are used to rotate the Rotating Top Assembly. Mounted between the main and stationary base plates are a series of wheels, or castors, which support the weight of the main base plate while riding on the stationary plate. These wheels allow for easy rotation of the main plate even when it includes the weight of a fully loaded PSD on top of it. Also on the top of the stationary plate are two rotation stops, one for each of clockwise and anti-clockwise rotation. A heavy spring-loaded bolt connects the stationary plate to the hub attached to the rotatable main plate; this bolt forms the axis of rotation. On the underside of the stationary plate is attached a relay box, this waterproof container encloses the electronic/electrical components such as relays and motor controllers that are used to control the Ball-Thrower's four motors.

Finally, a tubular support frame is attached to the underside of the stationary plate. In the embodiment shown, the frame includes an extension tube that is center-located along a fore-and-aft line, below and to the rear of the stationary plate to which the frame is connected. This tube allows the entire Ball-Thrower to be quickly and easily attached to a receiver of a ground vehicle such as a pick-up truck or UTV by insertion of the tube in to the receiver of the vehicle.

BRIEF DESCRIPTION OF THE DRAWINGS

The drawings which show by way of example the preferred embodiment of the invention are as follows.

DETAILED DESCRIPTION OF THE PREFERRED EMBODIMENTS

Figure 1:
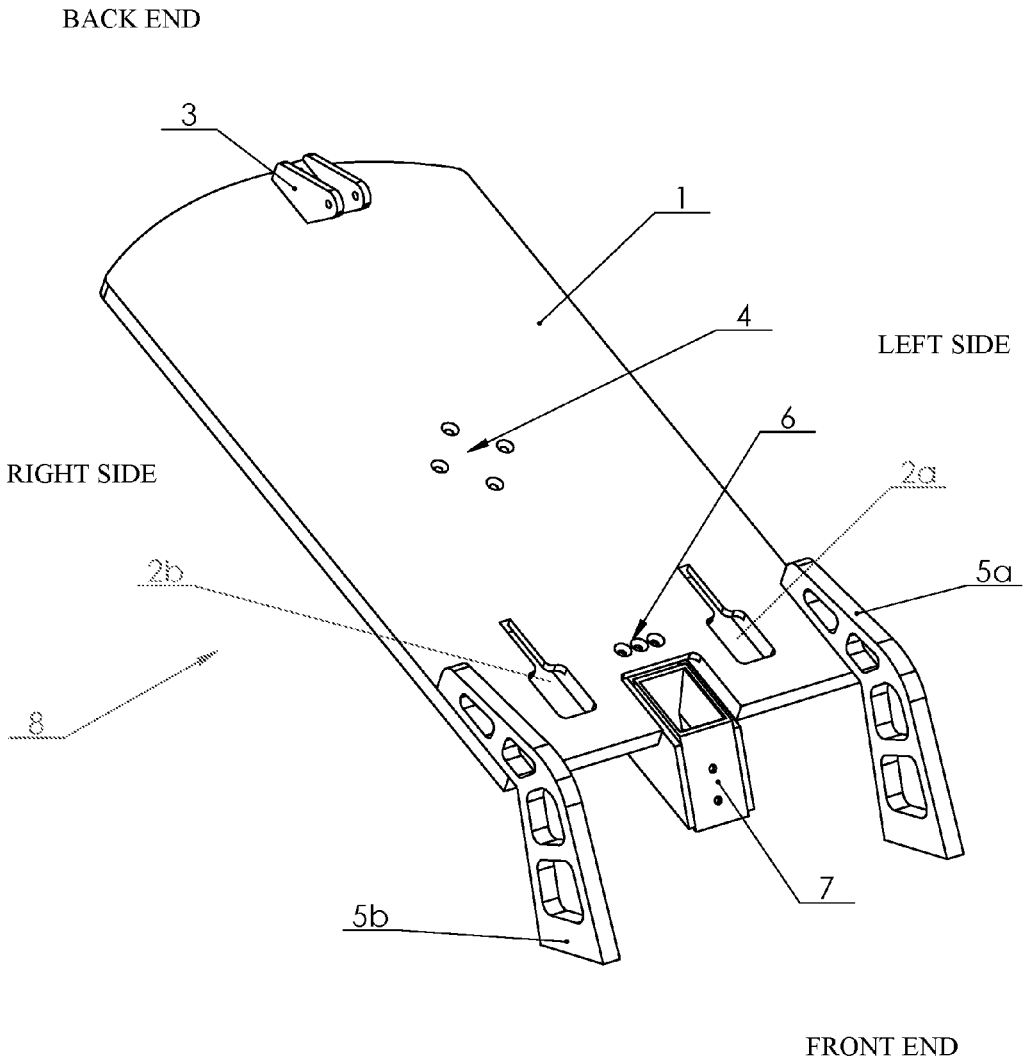
FIG. 1 is a perspective view of the top of the Main Base Plate Assembly.

The preferred embodiment of the present invention is shown in FIGS. 1 to 10*b*. NOTE: part numbers that are indicated in brackets, for example (99), are parts that are shown elsewhere than on the drawing being referenced, part numbers for the drawing being referenced are in italics. The Back/Front/Right/Left orientation indicated in FIG. 1 is consistent to the orientation used in all drawings for all parts or assemblies.

FIG. 1 shows the Main Base Plate Assembly 8. Plate 1 is engraved with identical slots 2*a* and 2*b* which are designed for the sliding engagement of a reversed T-shaped tab (T-shaped tab not shown). Clevis bracket 3 is used for engagement of a quick-release pin (pin not shown). These three features, 2*a*, 2*b* and 3, are the means by which a conventional PSD (Plastic Sphere Dispenser) machine, for instance the Spitfire™, is connected to the Ball-Thrower. The four bolt holes 4 are for mounting rotating hub (50) which forms the vertical axis around which the entire Rotating-Top Assembly (14), including the PSD mounted on top of it, is rotated for the purpose of adjusting the direction, or azimuth, in which the incendiary sphere is launched. Identical arms 5*a* and 5*b* are used to attach and align the Feeder-Head Assembly (13). Incendiaries enter the feeder head through tubular intake piece 7 which is attached by bolts through three bolt holes 6. This intake piece will align with the discharge tube of the PSD when the PSD is installed.

Figure 2:
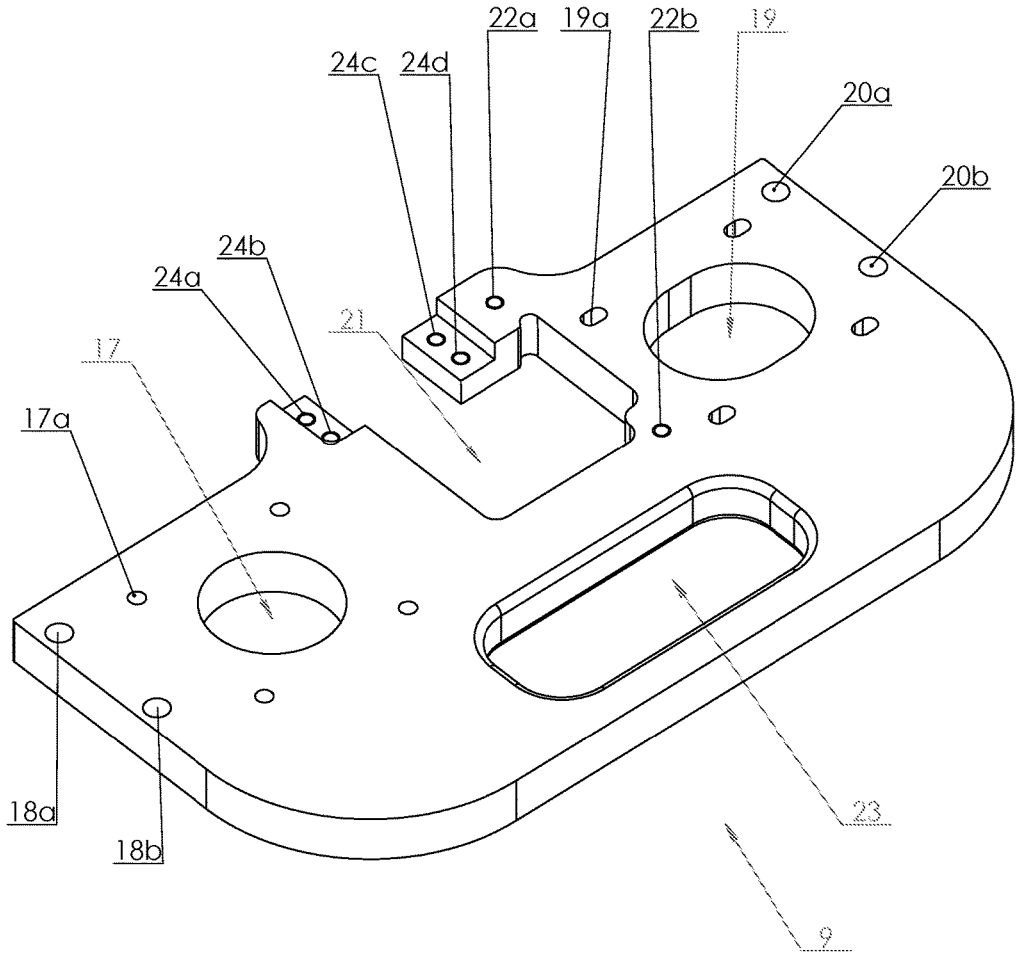
FIG. 2 is a perspective view of the top of the Spinner Base Plate.

FIG. 2 shows Spinner Base Plate 9. Large thru-hole 17 is where motor (44*b*) is mounted. The four smaller holes in a square pattern that are closest to hole 17, of which 17*a* is one, are the bolt holes through which the motor is mounted. Likewise, hole 19, with four bolt holes which 19*a* is one of, is where motor (44*a*) is mounted. It is seen that hole 19 is elongated while hole 17 is a circle. This is because one motor (44*b*) is fixed while the other motor (44*a*) is slightly adjustable for the purpose of fine tuning the distance between the two motors, thus the distance between the two spinners that are attached to those motors. It is also seen that the bolt holes that correspond to hole 19, of which 19*a* is one of, are also accordingly elongated. The holes 18*a* and 18*b* on the right side of the plate and 20*a* and 20*b* on the left side, are the bolt holes through which the support arms (5*a* and 5*b*) are attached. The large cut-out 21 is to allow space to mount the Feeder Assembly shown in upcoming drawings FIGS. 5*a* and 5*b*. The two holes 22*a* and 22*b* are to mount the Delivery Wheel Assembly of FIGS. 4*a* and 4*b*. The space 23 is a hand hold. The four recessed bolt holes 24*a*, 24*b*, 24*c* and 24*d* are to mount the Feeder Tube Assembly shown in FIGS. 3*a* and 3*b*.

Figure 3A:
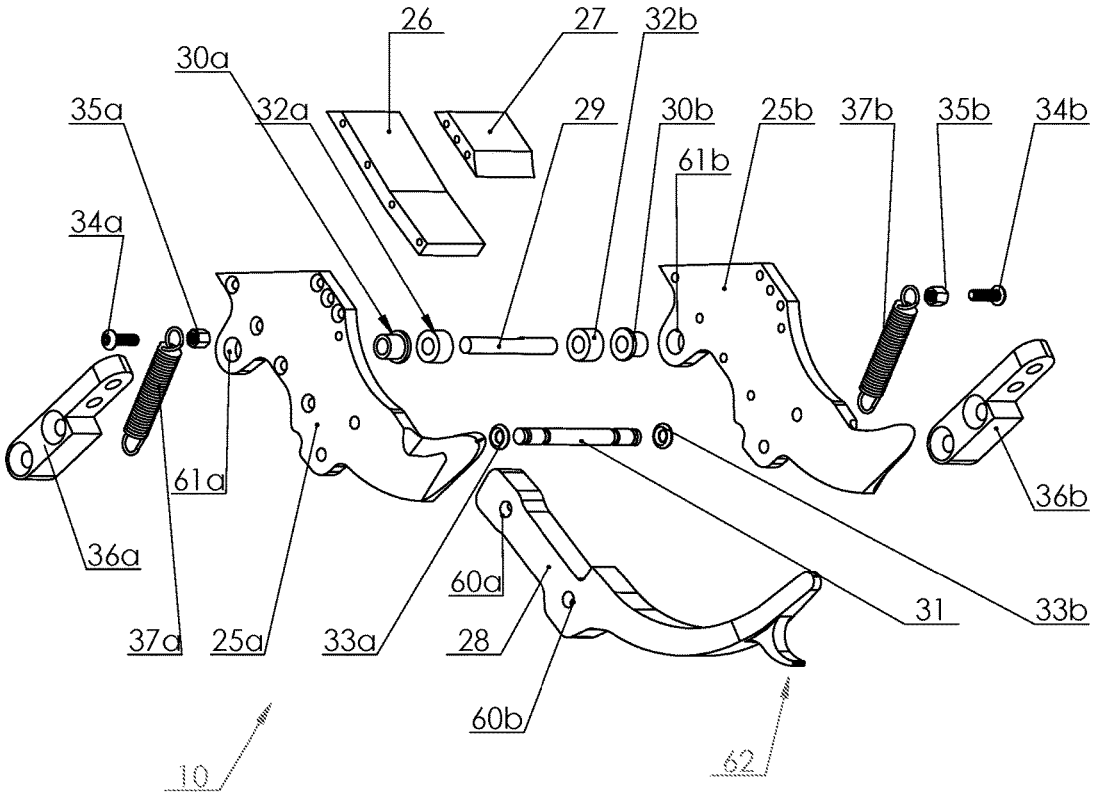
FIG. 3*a* is an exploded perspective view of the right forward side of the Feeder Tube Assembly.

FIG. 3*a* is an exploded view of the Feeder Tube Assembly 10. Bushing 30*a* is pressed in to hole 61*a* and bushing 30*b* is pressed in to hole 61*b*. The two sidewalls 25*a*, right side, and 25*b*, left side, are bolted together through the intersession of back piece 26 and front piece 27, thus forming, roughly speaking, a square tube. There are two pins that run through lower rail 28, upper pin 29 goes in hole 60*a* of the rail with identical spacers 32*a* and 32*b* on either side of the rail, the pin is inserted in to bushings 30*a* and 30*b* and set-screwed in place. Lower pin 31 goes through hole 60*b* of rail 28 and is also set-screwed in place, O-rings 33*a* and 33*b* are placed in the grooves of pin 31. Identical springs 37*a* and 37*b* are installed, one end of each spring is placed in the end groove of pin 31 and the other end of each spring is held by screws 34*a* and 34*b*, these screws also include stand-offs 35*a* and 35*b* to position the springs. The purpose for trigger 62 is to provide a finger-hold whereby lower rail 28 can be rotated downward for maintenance or cleaning purposes. When connecting tabs 36*a* and 36*b* are bolted to the sidewalls, the Feeder Tube Assembly is fully assembled and ready for attachment.

Figure 3B:
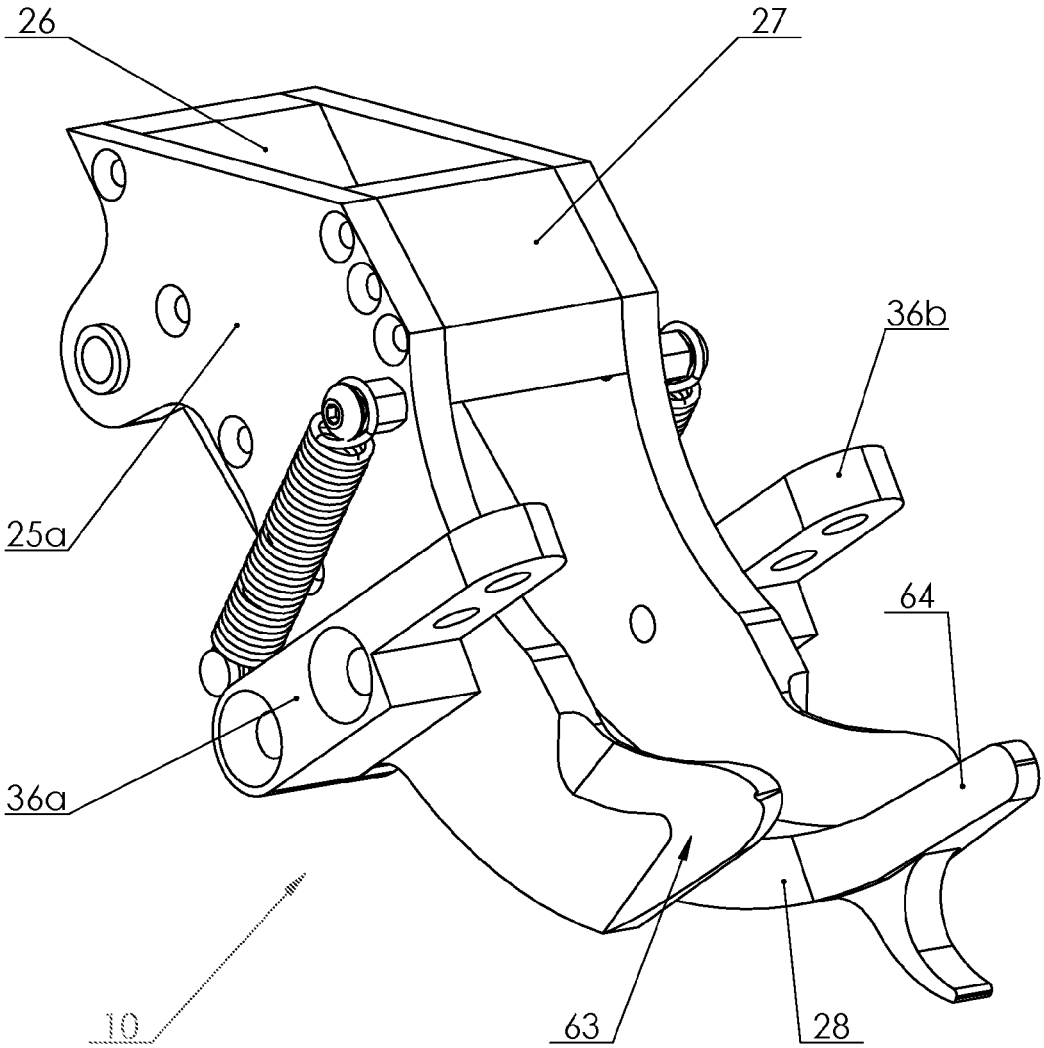
FIG. 3*b* is a perspective view of the right forward side of the Feeder Tube Assembly in an assembled condition.

FIG. 3*b* is a view of the fully assembled Feeder Tube Assembly 10. Several of the parts noted in (FIG. 3*a*) above are repeated here, namely: back piece 26 and front piece 27, right sidewall 25*a* wherein is noted the lower portion 63 which is sculpted and tapered for maximizing its close fit relative to the grooved spinning wheel. Two connecting tabs 36*a* and 36*b* connect the Feeder Tube Assembly to Spinner Base Plate (9) through bolts which screw in to bolt holes (24*a*, 24*b*, 24*c* and 24*d* of the Spinner Base Plate). On lower rail 28 is shown straight end 64 which is upwardly aligned along the center between, and at an angle parallel to, the also upwardly aligned spinner wheels (58*a* and 58*b*).

Figure 4A:
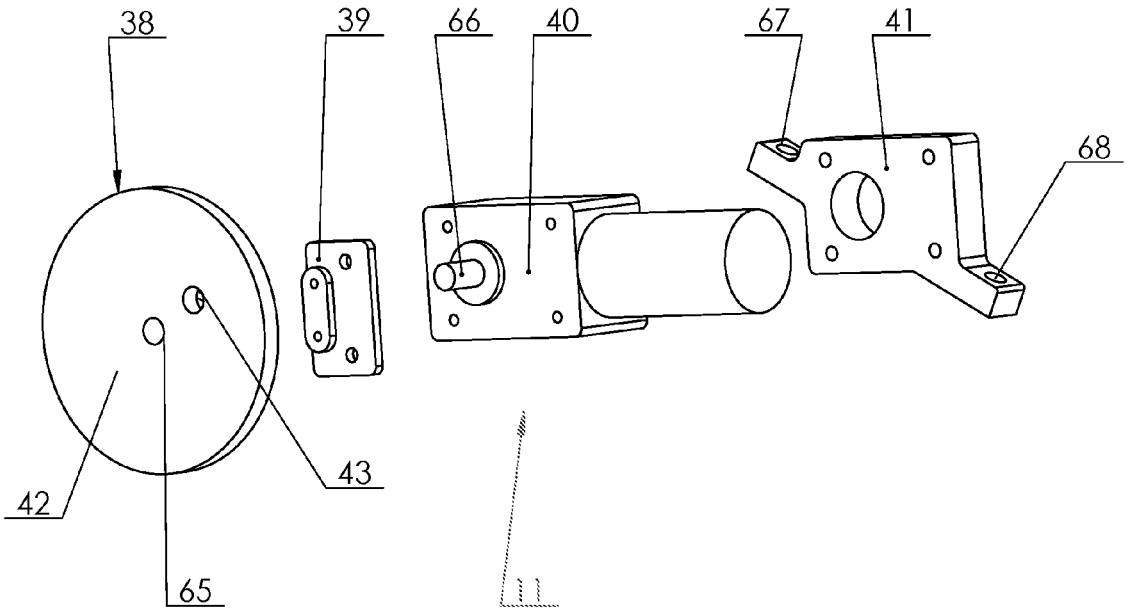
FIG. 4*a* is an exploded perspective view of the right forward side of the Delivering Wheel Assembly.

FIG. 4*a* is an exploded view of the Delivering Wheel Assembly (11). Delivering wheel 42 is attached, through center mounting hole 65, onto shaft 66 of gear-motor 40. Delivering wheel 42 includes a collar (69) (not shown in this view) through which a set-screw secures it to the motor shaft. The wheel's outer circumference 38 is, in the preferred embodiment, a knurled surface, but it is understood that this could be any surface that will create friction or mechanical interference between the delivering wheel and the incendiary sphere that the wheel is intended to move. Interceding piece 39, which attaches to gear-motor 40, is a mount for a magnetic sensor, the magnet this detects is pressed into hole 43 of the delivering wheel. This magnetic sensor becomes the basis for a possible RPM display feature, which is an optional feature not further discussed in this document. Mount piece 41 bolts to the opposite side of the motor gearbox (meaning the opposite side from piece 39). After mount piece 41 is attached, the Delivering Wheel Assembly is fully assembled. This assembly is then attached to Spinner Base Plate (9) by alignment of bolt holes 67 with (22*a*) and 68 with (22*b*).

Figure 4B:
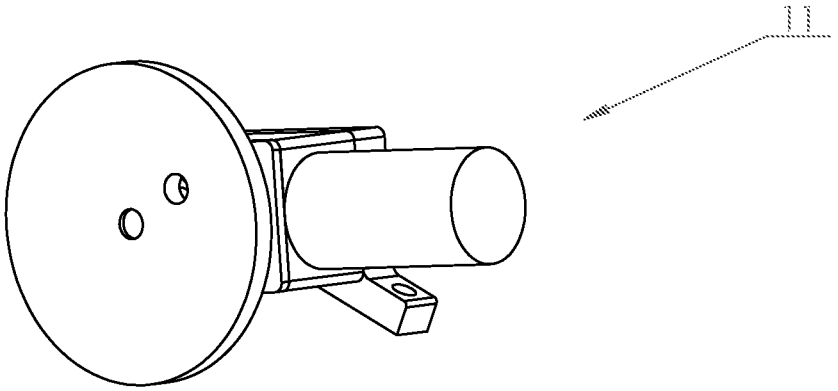
FIG. 4*b* is a perspective view of the right forward side of the Delivering Wheel Assembly in an assembled condition.

FIG. 4*b* is a view of the fully assembled Delivery Wheel Assembly 11.

Figure 5A:
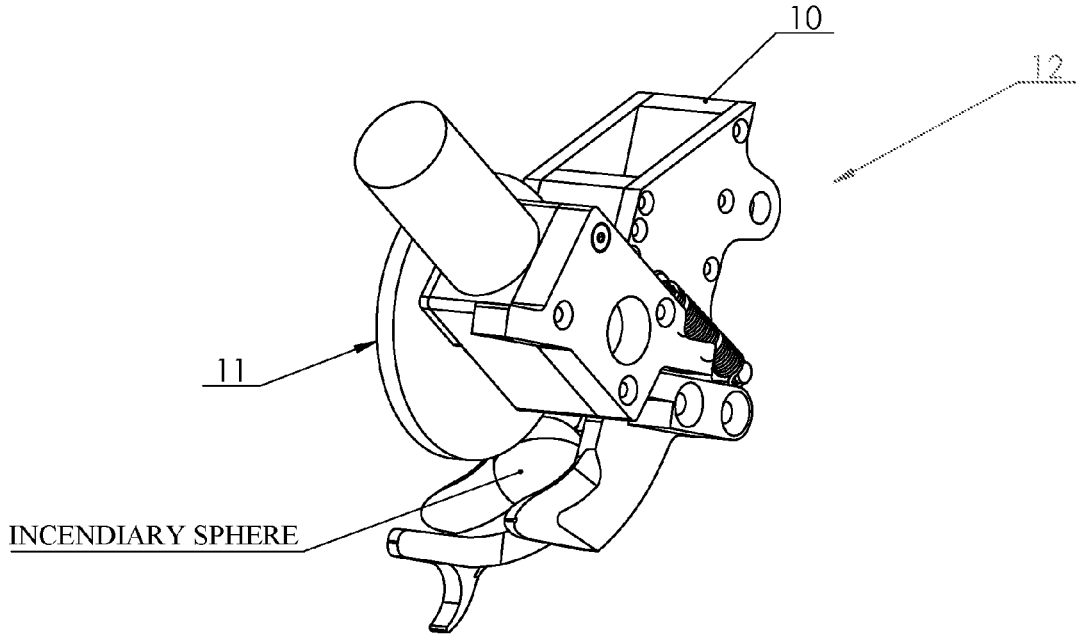
FIG. 5*a* is a perspective view of the left forward side of the Feeder Assembly which further includes an incendiary sphere.

FIG. 5*a* is a view of the Feeder Assembly 12. This Feeder Assembly is a combination of Delivery Wheel Assembly 11 and Feeder Tube Assembly 10. Feeder Assembly 12 includes all the mechanisms necessary to receive an incendiary sphere and then to pass it, or feed it, quickly and accurately to the launching point of the spinning wheels (58*a* and 58*b*). Although these two assemblies are shown in FIG. 5*a* and in FIG. 5*b* as being in conjunction with one another, this is for illustration purposes only. In actuality, Delivery Wheel Assembly 11 and Feeder Tube Assembly 10 are not directly connected to one other; they are both independently connected to Spinner Base Plate (9), but when they are so connected they are in the relationship to each other as depicted. Also shown in this drawing, which is not a component per se of the present invention, is an incendiary sphere. The sphere in this drawing is in the approximate position of first contact with the delivering wheel (42); from this point onward, first, lower rail (28) will spring downward then, upon further rotation of the delivering wheel, the incendiary sphere will be moved along the upper surface of the lower rail until that sphere is delivered to the launching point of the spinning wheels (58*a* and 58*b*).

Figure 5B:
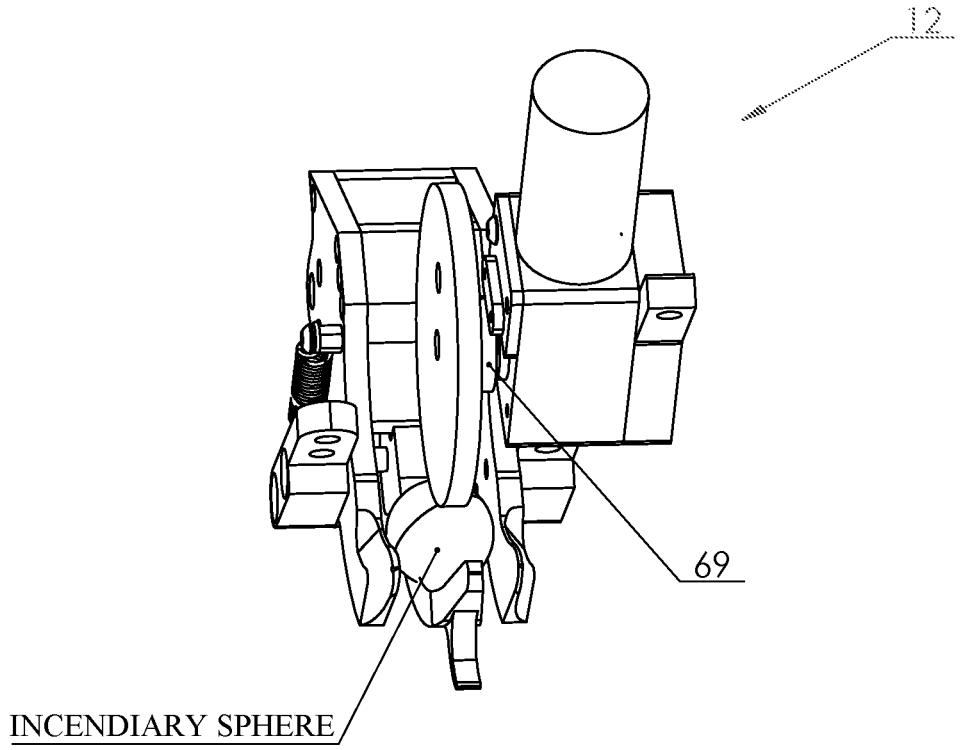
FIG. 5*b* is a perspective view of the forward end of the Feeder Assembly which further includes an incendiary sphere.

FIG. 5*b* is the same parts configuration as shown in FIG. 5*a*, namely that of Feeder Assembly 12 except it has been rotated to provide a better view of the front. Here is seen the collar 69 of delivery wheel (42), which is the collar through which a set screw secures the delivering wheel to the drive shaft of gear motor (40). Also again seen is an incendiary sphere, which is at the approximate position where it first pushes down the lower rail and just before the sphere begins its short journey to the point of launch.

Figure 6A:
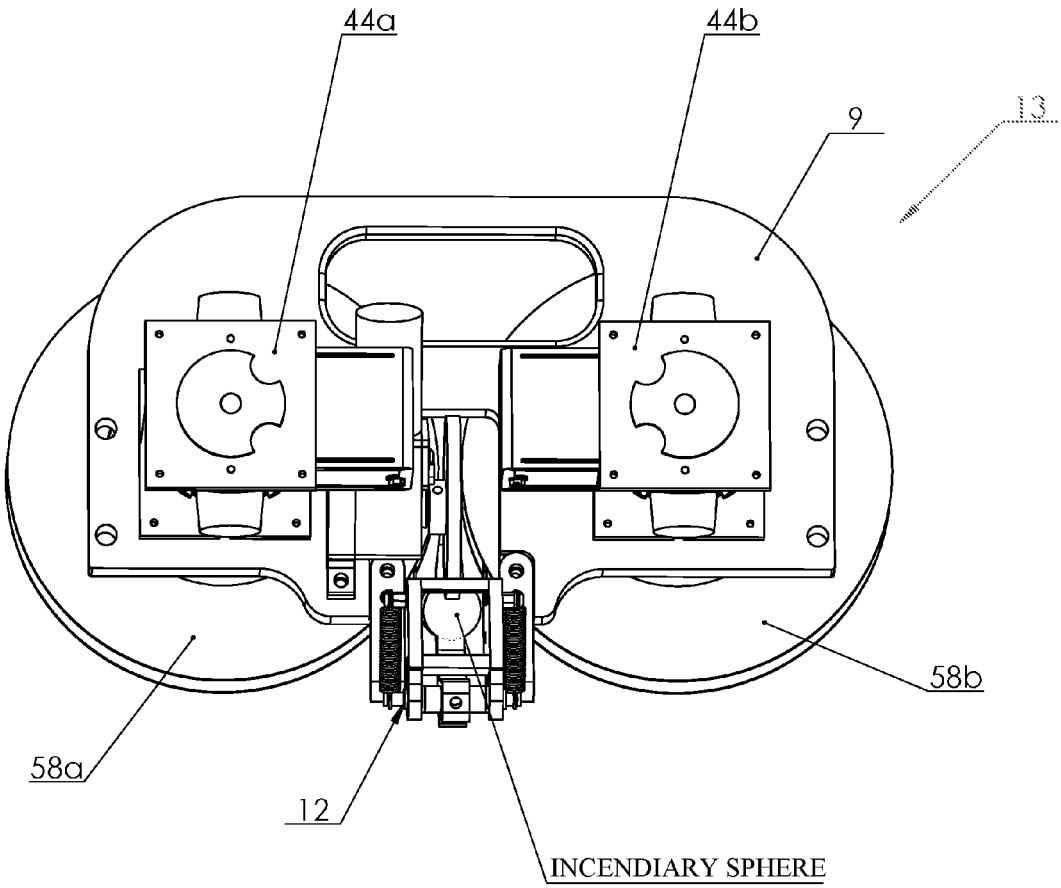
FIG. 6*a* is a top view of the Feeder-Head assembly which further includes an incendiary sphere.

In FIG. 6*a*, Feeder Assembly 12 is attached to Spinner Base Plate 9. To make that attachment, as previously described, bolt holes in tab (36*a*) are aligned with holes (24*c*) and (24*d*) and those of (36*b*) with (24*a*) and (24*b*), while (67) and (68) are aligned with (22*a*) and (22*b*). Motors 44*a* and 44*b* are also attached to Spinner Base Plate (9). Right side motor 44*b* is bolted through four bolt holes in Spinner Base (9), one of which is hole (17*a*). Left side motor 44*a* is bolted through four bolt holes in Spinner Base (9), one of which is hole (19*a*). Finally, after spinner wheel 58*a* is attached to the drive shaft of motor 44*a* and spinner wheel 58*b* is attached to the drive shaft of motor 44*b*, the Feeder Head Assembly 13 is fully assembled, and in this figure it is viewed from the top. An incendiary sphere is also shown in this figure; as in all other drawings showing this sphere, the sphere is depicted in the position of its initial contact with the delivering wheel.

Figure 6B:
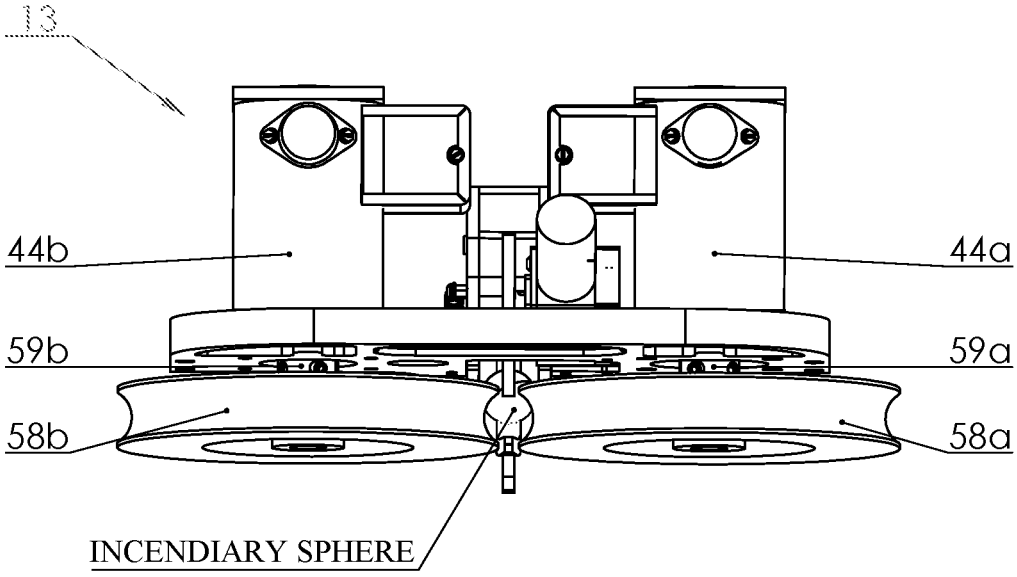
FIG. 6*b* is a perspective lower forward view of the Feeder-Head Assembly which further includes an incendiary sphere.

FIG. 6*b* is another view of Feeder Head Assembly 13, this time from the front. Left spinner wheel 58*a* is attached to the drive shaft of the left motor by use of shaft adapter 59*a*, and right spinner wheel 58*b* is attached to the drive shaft of the right motor by use of shaft adapter 59*b*.

Figure 6C:
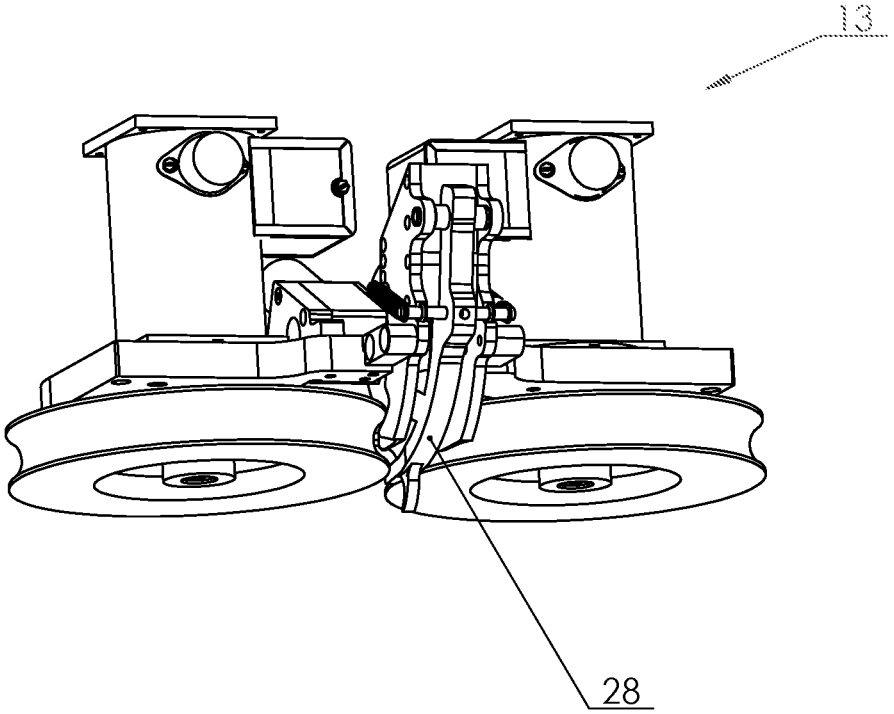
FIG. 6*c* is a perspective lower rear view of the Feeder-Head Assembly.

FIG. 6*c* is a third view of Feeder Head Assembly 13. In this view, a close inspection shows that the lower rail 28 is somewhat elevated relative to the vertical center of the grooves of the spinner wheels, which is where it should be prior to first contact between the sphere and the delivering wheel. It is important to consider that, if a sphere were to roll down the full length of the lower rail while it remained in this depicted position, that sphere would end up above the center of the two grooved wheels, but this is not what happens. What happens is that the delivering wheel first pushes down on the sphere, then the sphere pushes down on the rail. As a result, the rail lowers, while maintaining an upward spring force on the sphere, and, the now lower rail delivers the sphere not above the centerline of the grooved wheels, but at the centerline of the grooved wheels.

Figure 7A:
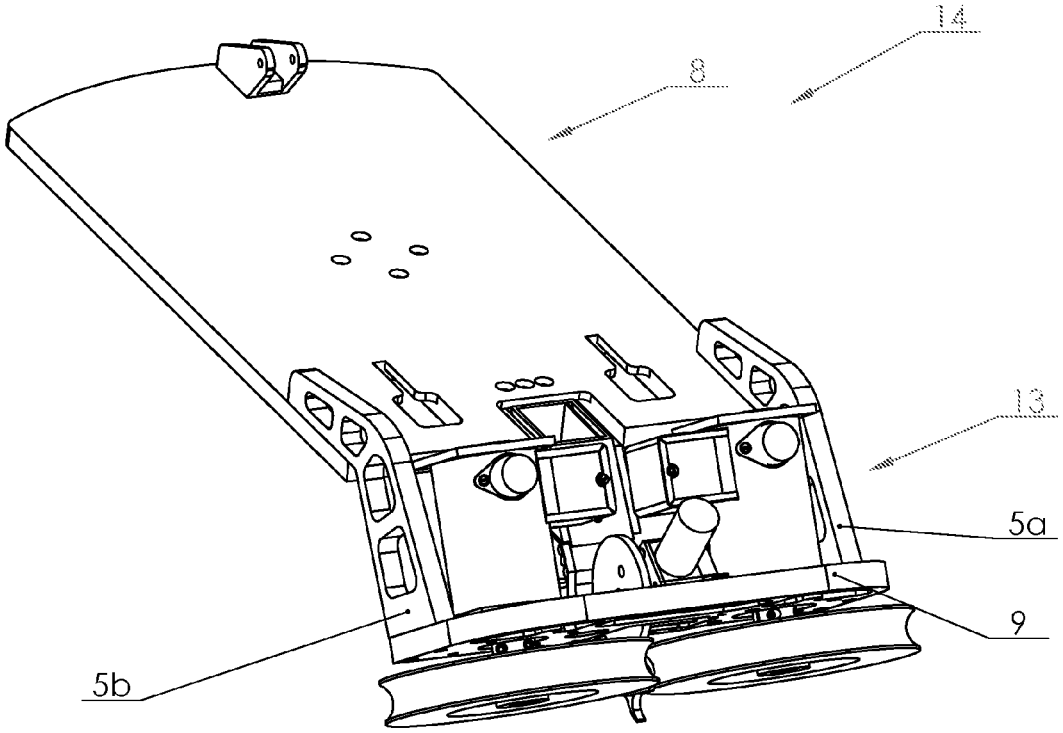
FIG. 7*a* is a perspective above view of the Rotating Top Assembly.

FIG. 7*a* shows Rotating Top Assembly 14. This assembly is formed by the connection of Feeder Head Assembly 13 to Main Base Assembly 8. The connection is made by bolting the left arm 5*a* of Main Base Assembly 8 to the left side of Spinner Base 9 through bolt holes (20*a*) and (20*b*), and also by bolting the right arm 5*b* of Main Base Assembly 8 to the right side of Spinner Base 9 through bolt holes (18*a*) and (18*b*).

Figure 7B:
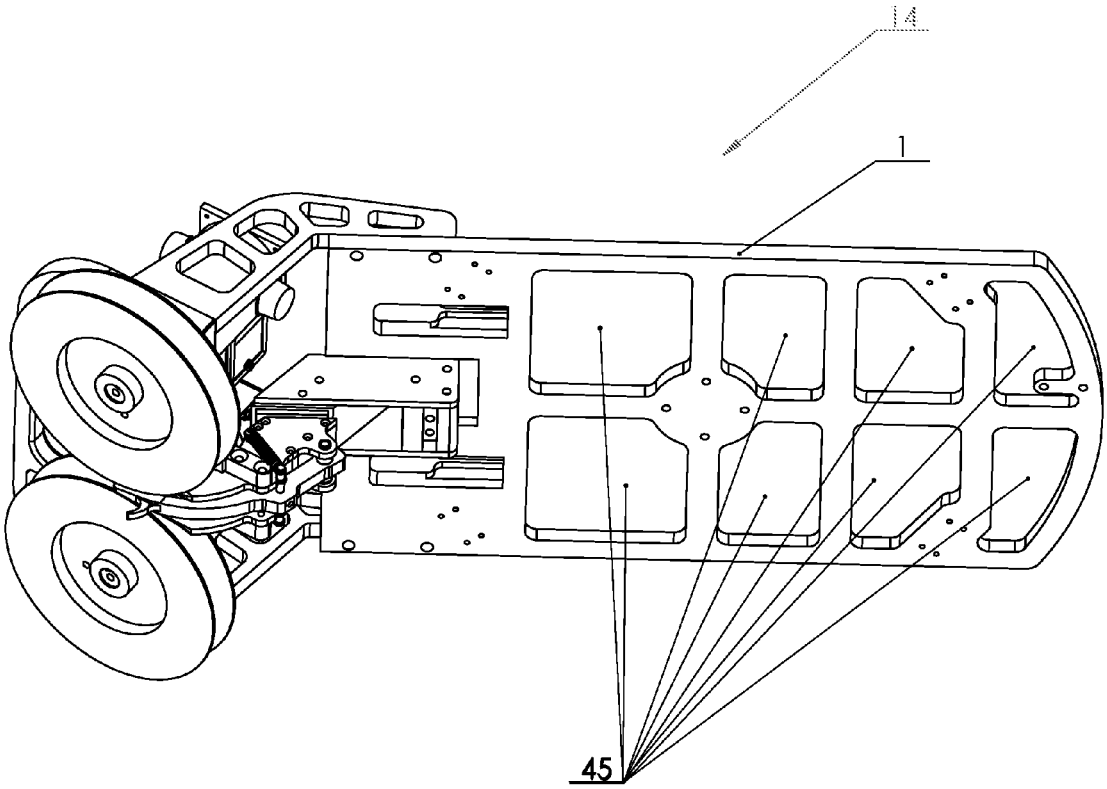
FIG. 7*b* is a perspective lower view of the Rotating Top Assembly.

FIG. 7*b*, also showing Rotating Top Assembly 14, is identical to the configuration in the previous figure except that it is rotated to reveal its underside. Note the eight pockets 45 engraved on the bottom of main base plate 1, which are for the purpose of weight reduction.

Figure 8:
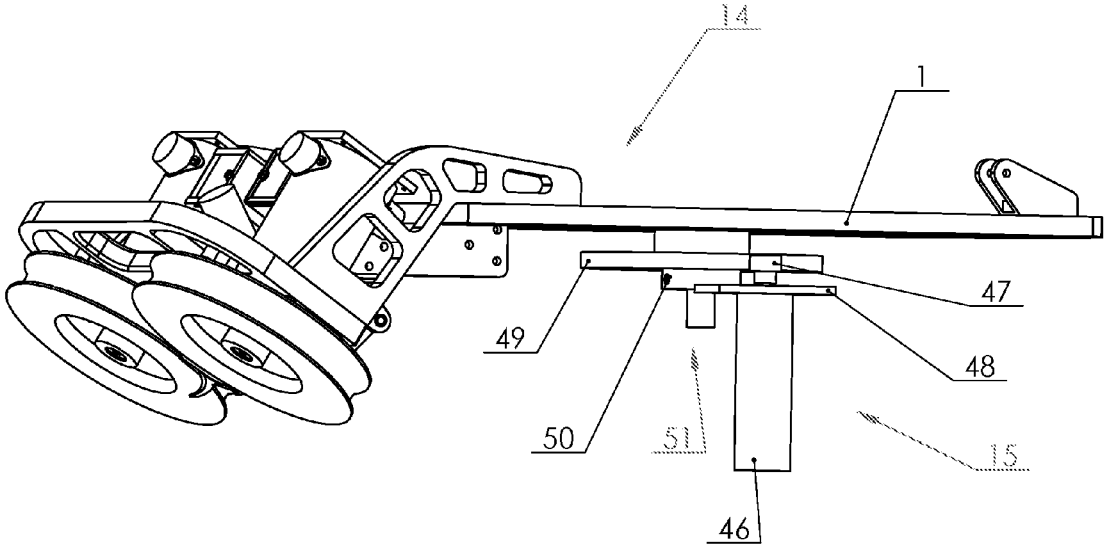
FIG. 8 is a perspective left view of the Rotation Assembly.

FIG. 8 shows the further inclusion of Rotation Assembly 15 as attached to Rotating Top Assembly 14. Rotation Assembly 15 includes gear 47 which is attached to the motor shaft of gear motor 46. Gear motor 46 is held by motor mount 48. Motor mount 48 is attached to stationary plate (16) as first shown in upcoming FIG. 9. Rotating hub 50 is bolted to main base plate 1 through four bolt holes (4). Attached to rotating hub 50 is rotation gear 49 which engages with gear 47. The bottom end 51 of rotating hub 50 passes through a center-hole in stationary plate (16) which then acts as a pivot for rotation.

Figure 9:
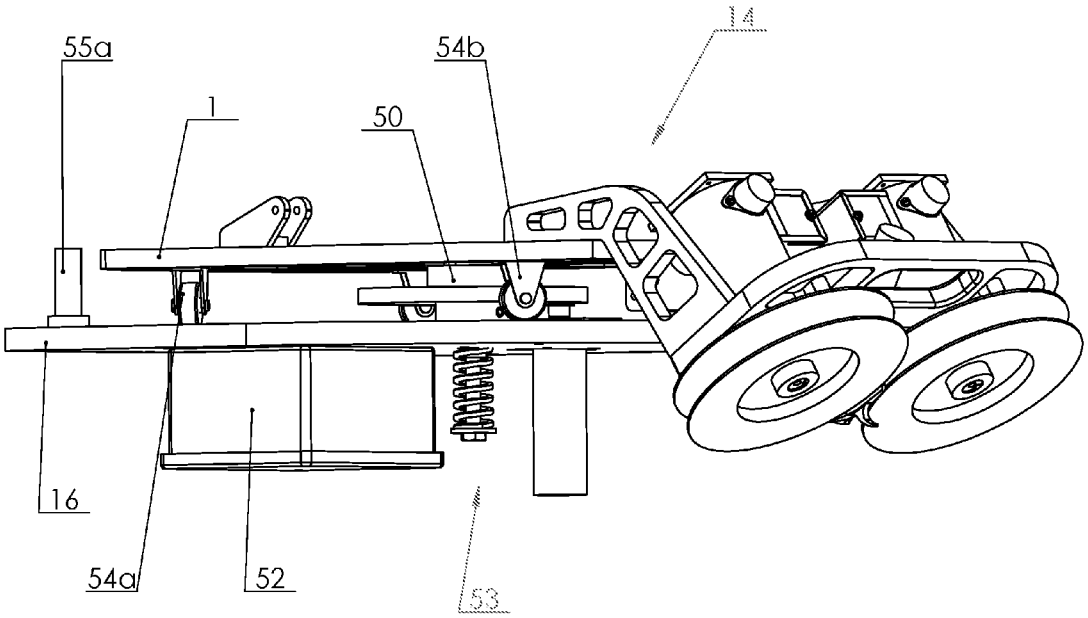
FIG. 9 is a perspective right lower view which shows certain detail below the main base plate which was not previously shown.

FIG. 9 shows the other features that are located below Main Base Assembly (8), the first of which is stationary base 16, this stationary base serves as a common mounting base for all of the non-rotating components much as main base plate 1 serves for all of the components associated with Rotating Top Assembly 14. Spring, bolt and washer 53 is used to attach main base plate 1 to stationary base 16; the bolt is screwed into the bottom end (51) of rotating hub 50. This bolt does not bottom out however, it merely partially compresses a heavy spring, thus this connection provides a certain amount of give between the two bases. Between the rotating and the stationary bases are four caster wheels, two of which are 54*a* and 54*b*, the other two are hidden, or partially hidden. These castor wheels are attached to main base plate 1 on top, and they ride on stationary base 16. Also seen is relay box 52 which contains the relays and other electrical/electronic components as necessary for controlling the Ball Thrower's four motors. There are two hard stops which limit the rotation of Rotating Top Assembly 14, one for clockwise motion and one for anti-clockwise motion; hard stop 55*a*, which limits clockwise rotation, is shown in this figure.

Figure 10A:
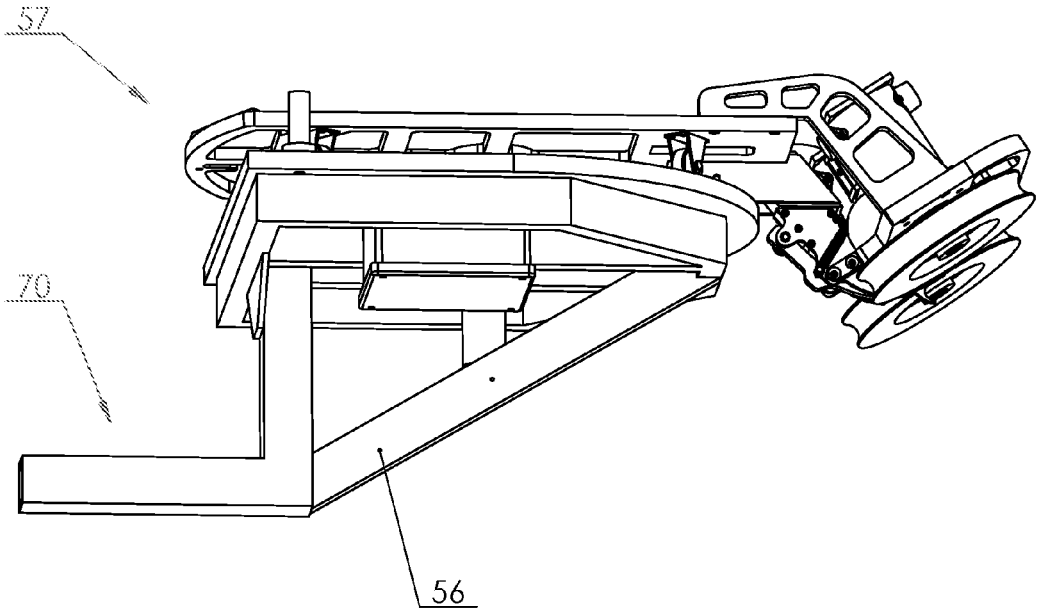
FIG. 10*a* is a perspective right lower view of the Ball-Thrower Assembly.

FIG. 10*a* shows Ball Thrower Assembly 57 which is a final complete assembly, to which has been added frame 56. This frame, designed with one particular means or vehicle in mind, is an example of a frame that might be used for a particular situation. In this case the frame is a welded tubular assembly that is used to mount the apparatus in the receiver of a ground vehicle. Extension 70 of the frame, which is the part that is placed inside the vehicle's receiver, is placed low so that the apparatus will have sufficient ground clearance, and it is placed rearward so that there is sufficient room for the apparatus to operate clear of the vehicle.

Figure 10B:
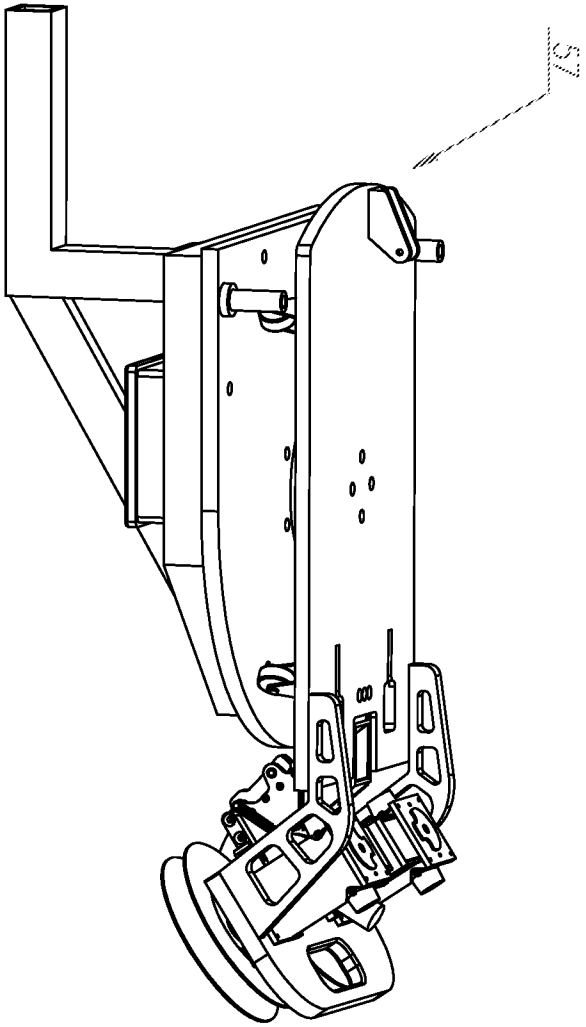
FIG. 10*b* is a perspective right upper view of the Ball-Thrower Assembly.

FIG. 10*b* is an upper right side view of Ball Thrower Assembly 57.

These and other advantages may be obtained through the use of the inventive apparatus and methods disclosed herein. While the invention has been described with reference to specific embodiments, the description is illustrative and is not to be construed as limiting the scope of the invention. Various modifications and changes may occur to those skilled in the art without departing from the spirit and scope of the invention described herein and as set forth in the appended claims.

I claim:

1. An apparatus for launching incendiary spheres comprising:

(a) a sphere processing machine that processes incendiary spheres therefrom, wherein the sphere processing machine includes mechanisms to inject the incendiary spheres with a reactant, and (b) a launching device for launching incendiary spheres that are received from the sphere processing machine, said launching device comprising:

(i) a plurality of spinning wheels which are used to convey velocity to said incendiary spheres by contacting said incendiary spheres;

(ii) a delivering wheel which moves said incendiary spheres to a desired launching point relative to said plurality of spinning wheels; and (iii) means to provide rotational velocity to said plurality of spinning wheels; and (iv) means to provide rotational velocity to said delivering wheel;

(v) a pathway connected to the processing machine and the plurality of spinning wheels for receiving incendiary spheres from the processing machine and for delivering the received incendiary spheres to the plurality of spinning wheels.

2. The apparatus of claim 1, wherein said incendiary spheres are in a charged condition when launched by said apparatus.

3. The apparatus of claim 2, wherein the launching device includes a lower rail or lower surface that said incendiary spheres move upon.

4. The apparatus of claim 3, wherein said lower rail or lower surface has an upper surface, and whereby the upper surface of said lower rail or lower surface defines the pathway, and wherein the pathway terminates at the said launching point.

5. The apparatus of claim 4, whereby said lower rail or lower surface is spring mounted.

6. The apparatus of claim 4, wherein said lower rail or lower surface is abounded on both sides by sidewalls.

7. The apparatus of claim 1, wherein said delivering wheel is a circular disc having an outer circumference.

8. The apparatus of claim 7, wherein the outer circumference of said circular disc has a rough or high friction outer surface.

9. The apparatus of claim 5, whereby said incendiary sphere is pressed between said delivering wheel and said lower rail or lower surface as it is moved to said desired launching point.

10. The apparatus of claim 1, wherein said plurality of spinning wheels includes a concave groove.

11. The apparatus of claim 10, wherein said concave groove has a constant radius.

12. The apparatus of claim 11, wherein said constant radius is approximately equal to the spherical radius of said incendiary sphere.

13. The apparatus of claim 1, wherein the means to provide rotational velocity to the plurality of spinning wheels comprises a motor.

14. The apparatus of claim 1, wherein the means to provide rotational velocity to the delivering wheel comprises a motor.

15. The apparatus of claim 1, wherein said plurality of spinning wheels used to convey velocity to said incendiary spheres are arranged to control the azimuth and the distance the spheres are launched.

16. The apparatus of claim 1, wherein said plurality of spinning wheels have a circumference, and wherein said circumference is used to convey velocity to said incendiary spheres.

* * * * *